US008800325B2

(12) United States Patent
Chung et al.

(10) Patent No.: US 8,800,325 B2
(45) Date of Patent: Aug. 12, 2014

(54) WASHING MACHINE

(75) Inventors: Seung Hwan Chung, Suwon-si (KR); Seung Kyu Park, Seoul (KR); Myung Sun Kang, Suwon-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 199 days.

(21) Appl. No.: 13/399,548

(22) Filed: Feb. 17, 2012

(65) Prior Publication Data

US 2012/0210753 A1 Aug. 23, 2012

(30) Foreign Application Priority Data

Feb. 18, 2011 (KR) ..... 10-2011-0014573

(51) Int. Cl.
*D06F 39/14* (2006.01)

(52) U.S. Cl.
USPC ..... 68/17 R; 68/196; 68/3 R; 68/24; 68/12.26; 134/200; 134/57 DL; 134/58 DL

(58) Field of Classification Search
CPC ..... D06F 39/14; D06F 37/28; D06F 39/02; D06F 23/04; D06F 37/42
USPC ..... 68/17 R, 13 R, 264, 272, 5 C, 200, 142, 68/3 R, 175, 196, 235 R, 23.5, 5 E, 12.26; 134/56 R, 57 R, 57 DL, 58 R, 58 DL, 93, 134/186, 99.2, 26, 18, 115 R, 6, 22.1, 22.14, 134/84; 222/1, 173, 185, 386, 52, 105, 129, 222/145.1, 207, 94; 422/261, 272, 291, 422/292, 300, 5; 312/228, 237, 319.2, 211, 312/228.1, 326, 332.1
See application file for complete search history.

(56) References Cited

U.S. PATENT DOCUMENTS

| | | | | |
|---|---|---|---|---|
| 7,293,436 | B2 * | 11/2007 | No et al. | 68/17 R |
| 8,176,757 | B2 * | 5/2012 | Yoo et al. | 68/196 |
| 2004/0083769 | A1 * | 5/2004 | Kim et al. | 68/12.02 |

* cited by examiner

*Primary Examiner* — Michael Barr
*Assistant Examiner* — Thomas Bucci
(74) *Attorney, Agent, or Firm* — Staas & Halsey LLP

(57) ABSTRACT

A washing machine having a structure which stably supports a hose or a wire used in the washing machine to prevent sagging or movement of the hose or the wire. The washing machine includes a main body, a spin basket disposed within the main body, an upper cover connected to the upper portion of the main body, a detergent box connected to the bottom surface of the upper cover to supply detergent to the inside of the spin basket, a water supply valve connected to the rear end of the upper cover, a water supply hose connecting the water supply valve to the detergent box, and a support bracket connected to the bottom surface of the upper cover to support the water supply hose so as to prevent sagging of the water supply hose.

20 Claims, 6 Drawing Sheets

WASHING MACHINE

CROSS-REFERENCE TO RELATED APPLICATIONS

This application claims the priority benefit of Korean Patent Application No. 10-2011-0014573, filed on Feb. 18, 2011 in the Korean Intellectual Property Office, the disclosure of which is incorporated herein by reference.

BACKGROUND

1. Field

Embodiments relate to a washing machine having a structure which fixes and supports a hose or a wire in the washing machine.

2. Description of the Related Art

A washing machine is an apparatus to wash laundry using electricity, and generally includes a tub to store wash water, a spin basket rotatably installed in the tub, a pulsator rotatably installed on the bottom of the spin basket, and a motor to rotate the spin basket and the pulsator.

When the motor rotates the spin basket and the pulsator under the condition that laundry and wash water are placed within the spin basket, the pulsator agitates the laundry placed in the spin basket together with the wash water, thereby removing dust from the laundry.

In general, a hose serving as a path to supply, drain and circulate the wash water and an electric wire to connect a control device controlling the operation of the washing machine and electric components controlled by the control device are used in the washing machine. A structure or component to prevent the hose or wire from interfering with devices in the washing machine is required.

SUMMARY

Therefore, it is an aspect of one or more embodiments to provide a washing machine having a structure which stably supports a hose or a wire used in the washing machine to prevent sagging or movement of the hose or the wire.

Additional aspects one or more embodiments will be set forth in part in the description which follows and, in part, will be apparent from the description, or may be learned by practice of the invention.

In accordance with an aspect of embodiments, a washing machine includes a main body, a spin basket disposed within the main body, an upper cover connected to the upper portion of the main body, a detergent box connected to the bottom surface of the upper cover to supply detergent to the inside of the spin basket, a water supply valve connected to the rear end of the upper cover, a water supply hose connecting the water supply valve to the detergent box, and a support bracket connected to the bottom surface of the upper cover to support the water supply hose so as to prevent sagging of the water supply hose.

The support bracket may include a body and a support holder bent from one side of the body to support the water supply hose.

The support holder may include an accommodation part to accommodate the water supply hose and a connection hole to which a fixing wire to fix the water supply hose accommodated in the accommodation part to the support bracket is connected.

One side of the accommodation part may be opened to accommodate the water supply hose in the accommodation part.

The water supply hose may be accommodated in the accommodation part and be located between the accommodation part and the bottom surface of the upper cover.

The support bracket may further include a guide to guide the water supply hose to the accommodation part.

The guide may include a contact part contacting the water supply hose, and the contact part may be formed in a bending structure to prevent damage to the water supply hose.

The support bracket may include a fixing part to fix the support bracket to the upper cover, and the fixing part may be bent from one side of the support bracket.

A door may be connected to the upper portion of the upper cover, and the upper cover may include an opening opened and closed by the door, a detergent injection hole provided at a position corresponding to the detergent box to inject the detergent into the detergent box, and a control device accommodation part at which a control device to control operation of the washing machine is located.

The accommodation part may accommodate and support an electric wire connected to the control device together with the water supply hose.

A door lock device to prevent the door from being opened during operation of the washing machine may be connected to the bottom surface of the upper cover, the door lock device may be connected to the control device through the electric wire, and the electric wire may be accommodated in and supported by the accommodation part together with the water supply hose.

In accordance with another aspect of one or more embodiments, a washing machine includes frames forming the external appearance of the washing machine, a spin basket disposed within the frames, an upper cover connected to the upper portions of the frames and provided with an opening through which laundry is put into the spin basket, a door to open and close the opening, and a support bracket fixed to the bottom surface of the upper cover to support a hose and/or an electric wire located at the inside of the upper cover.

The support bracket may include a body and a door connection part provided at one side of the body to connect the upper cover to the door.

A hinge device may be provided at both ends of the door, and the door connection part may include a shaft connection hole connected to the hinge device.

The support bracket may further include a support holder bent from one side of the body to support the hose or the electric wire.

The support holder may include an accommodation part, one side of which is opened to accommodate the hose or the electric wire, and a connection hole to which a fixing wire to fix the hose and/or the electric wire accommodated in the accommodation part to the support bracket is connected.

The support holder may further include a guide to guide the hose and/or the electric wire to the accommodation part.

The washing machine may further include a detergent box connected to the bottom surface of the upper cover to supply detergent to the inside of the tub, and the upper cover may include a detergent injection hole provided at a position corresponding to the detergent box to inject the detergent into the detergent box, and a control device accommodation part at which a control device to control operation of the washing machine is located.

The hose may be a water supply hose connecting the detergent box to an external water supply hose to supply water to the detergent box.

A door lock device to prevent the door from being opened during operation of the washing machine may be connected to the bottom surface of the upper cover, and the door lock device may be connected to the control device through the electric wire.

The control device accommodation part may be divided from an inner space, formed by the frames, by a diaphragm provided on the upper cover, and the diaphragm may be provided with a through hole to pass the electric wire connecting the door lock device to the control device.

BRIEF DESCRIPTION OF THE DRAWINGS

These and/or other aspects of embodiments will become apparent and more readily appreciated from the following description of embodiments, taken in conjunction with the accompanying drawings of which.

DETAILED DESCRIPTION

Figure 1:
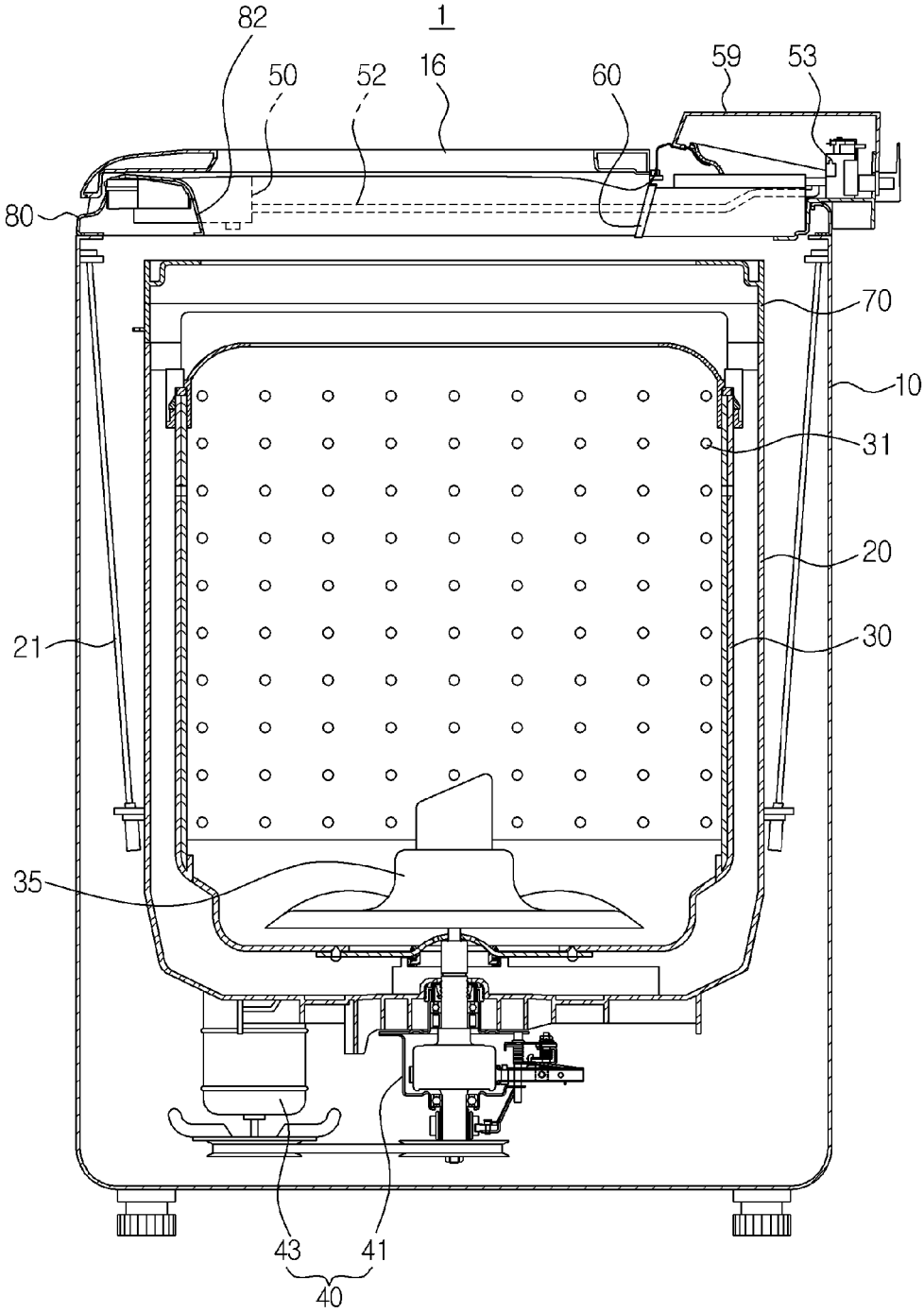
FIG. 1 is a cross-sectional view of a washing machine in accordance with an embodiment.

Reference will now be made in detail to embodiments, examples of which are illustrated in the accompanying drawings, wherein like reference numerals refer to like elements throughout.

FIG. 1 is a cross-sectional view of a washing machine in accordance with an embodiment.

As shown in FIG. 1, a washing machine 1 includes a main body 10 forming the external appearance of the washing machine 1, a tub 20 disposed within the main body 10, a spin basket 30 rotatably disposed within the tub 20, and a drive device 40 disposed under the tub 20 to rotate the spin basket 30.

An upper cover 80 provided with an opening 82 through which laundry is put into the spin basket 30 is provided on the upper portion of the main body 10. A door 16 to open and close the opening 82 is connected to the upper cover 80, and a control device accommodation part 86 (with reference to FIG. 2) provided at the rear portion of the upper cover 80 is shielded by a cover member 59.

A first detergent box 60 and a second detergent box 50 to supply detergent to the inside of the tub 20 are provided on the upper cover 80. The first detergent box 60 is provided in a drawer type at one side of the opening 82 of the upper cover 80, and the second detergent box 60 is provided on the bottom surface of the upper cover 80.

Suspension devices 21 to suspend the tub 20 to the main body 10 to support the tub 20 are connected to the outer surface of the tub 20, and a ring-shaped tub cover 70 to cover the tub 20 is connected to the upper end of the tub 20.

The spin basket 30 is rotatably disposed within the tub 20 and is provided with a plurality of through holes 31.

The pulsator 35 is rotatably installed on the bottom of the spin basket 30 and serves to agitate laundry placed within the spin basket 30 together with wash water.

The drive device 40 includes a clutch 41 to rotate the spin basket 30 and the pulsator 35, and a drive motor 43 to drive the clutch 41. The drive motor 43 is connected to the clutch 41 by a pulley and a belt, thus transmitting drive force to the spin basket 30 and the pulsator 35.

A water supply valve 53 is installed at the rear end of the upper cover 80. Water supplied through the water supply valve 53 is directly supplied to the first detergent box 60 and is introduced into the tub 20 together with detergent, or is supplied to the second detergent box 50 through a water supply hose 52 and is introduced into the tub 20 together with detergent.

Figure 2:
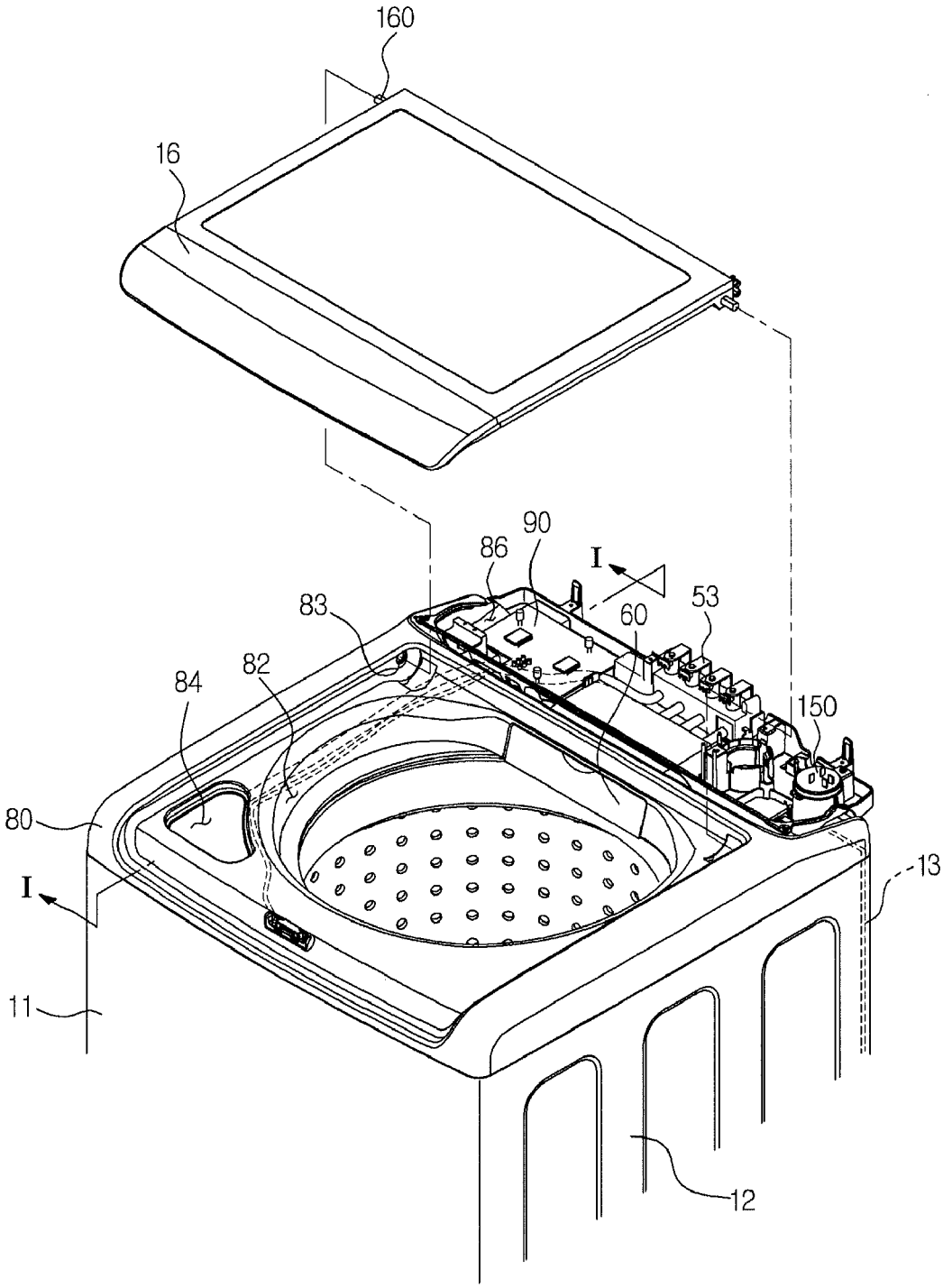
FIG. 2 is a view illustrating main components of the upper portion of the washing machine in accordance with an embodiment.
Figure 3:
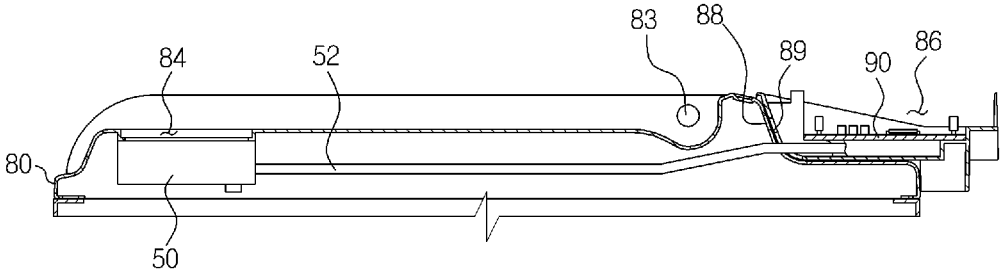
FIG. 3 is a cross-sectional view of an upper cover, taken along the line 'I-I' of FIG. 2.
Figure 4:
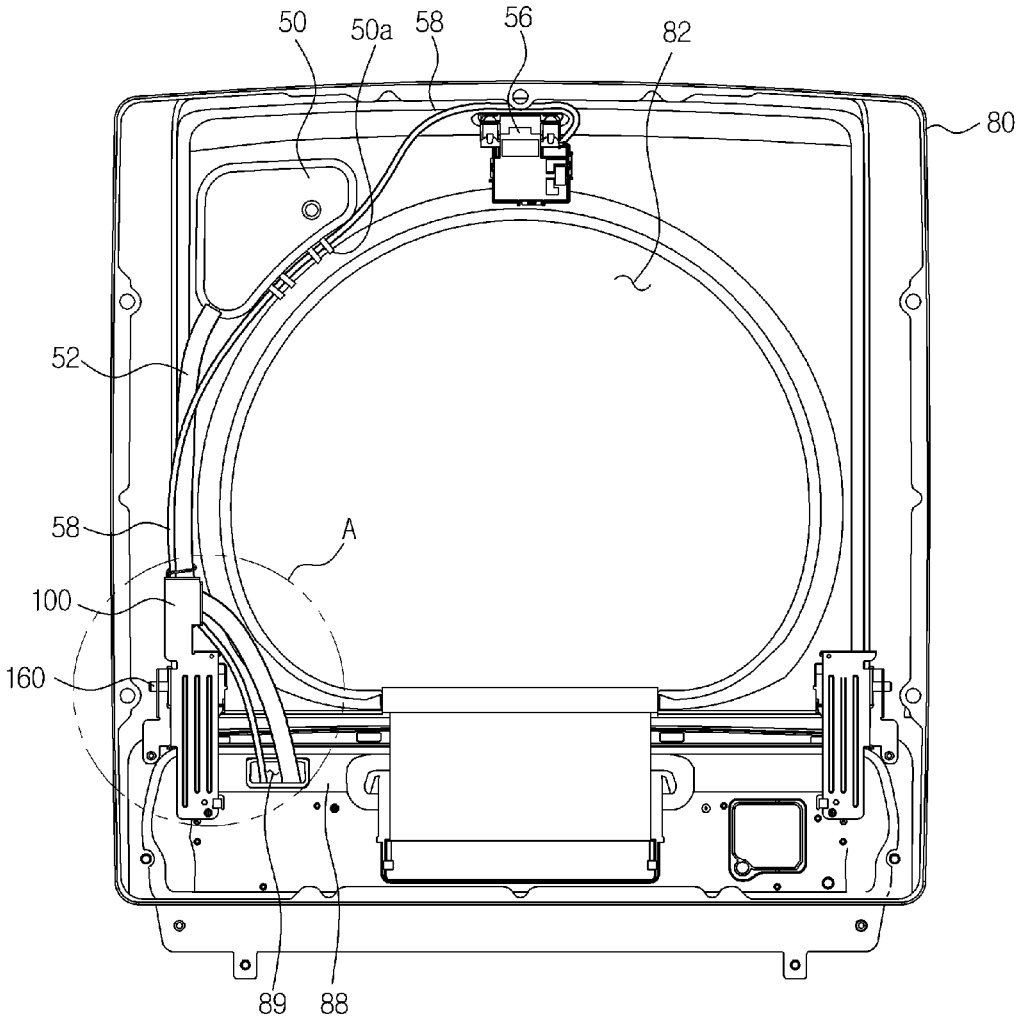
FIG. 4 is a bottom view of the upper cover.

FIG. 2 is a view illustrating main components of the upper portion of the washing machine in accordance with an embodiment, FIG. 3 is a cross-sectional view of the upper cover, taken along the line 'I-I' of FIG. 2, and FIG. 4 is a bottom view of the upper cover.

As shown in FIGS. 2 to 4, the main body 10 includes frames 11, 12 and 13, and the frames 11, 12 and 13 include a front frame 11, side frames 12, and a rear frame 13 forming front, side and rear surfaces of the main body 10.

The upper cover 80 is connected to the upper portions of the frames 11, 12 and 13. The upper cover 80 includes door connection holes 83 to which the door 16 is rotatably connected, the opening 82 opened and closed by the door 16 so that a user puts laundry into the spin basket 30 through the opening 82 during washing, and a detergent injection hole 84 provided at a position corresponding to the second detergent box 50 connected to the bottom surface of the upper cover 80 to inject detergent into the second detergent box 50. The user may conveniently put the detergent into the second detergent box 50 through the detergent injection hole 84 provided at the upper cover 80 in the opened state of the door 16.

Further, the control device accommodation part 86 which accommodates a control device 90 controlling various operations of the washing machine 1 during washing is provided at the rear portion of the upper cover 80, i.e., a portion of the upper cover 80 adjacent to the rear frame 13. The control device accommodation part 86 is divided from a space, formed by the frames 11, 12 and 13 and the upper cover 80, by a diaphragm 88. Wash water scattered during a washing process is blocked by the diaphragm 88 and is not introduced into the control device accommodation part 86, and thus a failure, such as an electrical short generated due to contact of the wash water with the control device 90 located at the control device accommodation part 86, may be prevented.

The second detergent box 50 to supply the detergent to the inside of the tub 20 and a door lock device 56 to prevent opening of the door 16 during operation of the washing machine 1 are provided on the bottom surface of the upper cover 80.

The water supply hose 52 to supply water to the second detergent box 50 is connected to the second detergent box 50. The water supply hose 52 connects the second detergent box 50 and the water supply valve 53 to each other by a through hole 89 formed on the diaphragm 88. The second detergent box 50 may include support ribs **50*a* to support an electric wire 58 connecting the control device 90 and the door lock device 56** to each other.

The electric wire 58 is connected to the door lock device 56. The electric wire 58 connects the door lock device 56 and the control device 90 to each other via the through hole 89 provided on the diaphragm 88 in the same manner as the water supply hose 52.

Further, a support bracket 100 connecting the door 16 and the upper cover 80 to each other to enable the door 16 to be rotated relative to the upper cover 80 and accommodating and supporting the water supply hose 52, and the electric wire 58 is provided on the bottom surface of the upper cover 80.

Hereinafter, the structure and function of the support bracket 100 will be described in detail.

Figure 5:
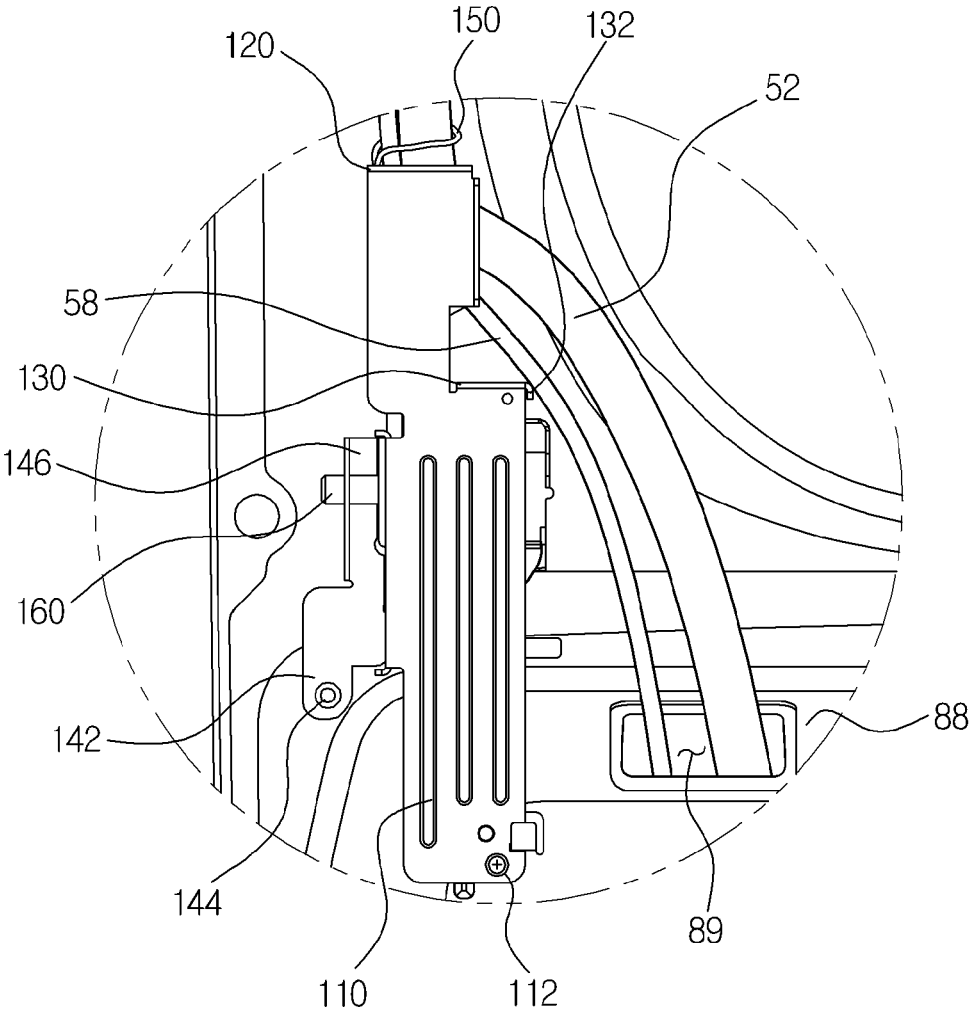
FIG. 5 is an enlarged view of the portion 'A' of FIG. 4.
Figure 6:
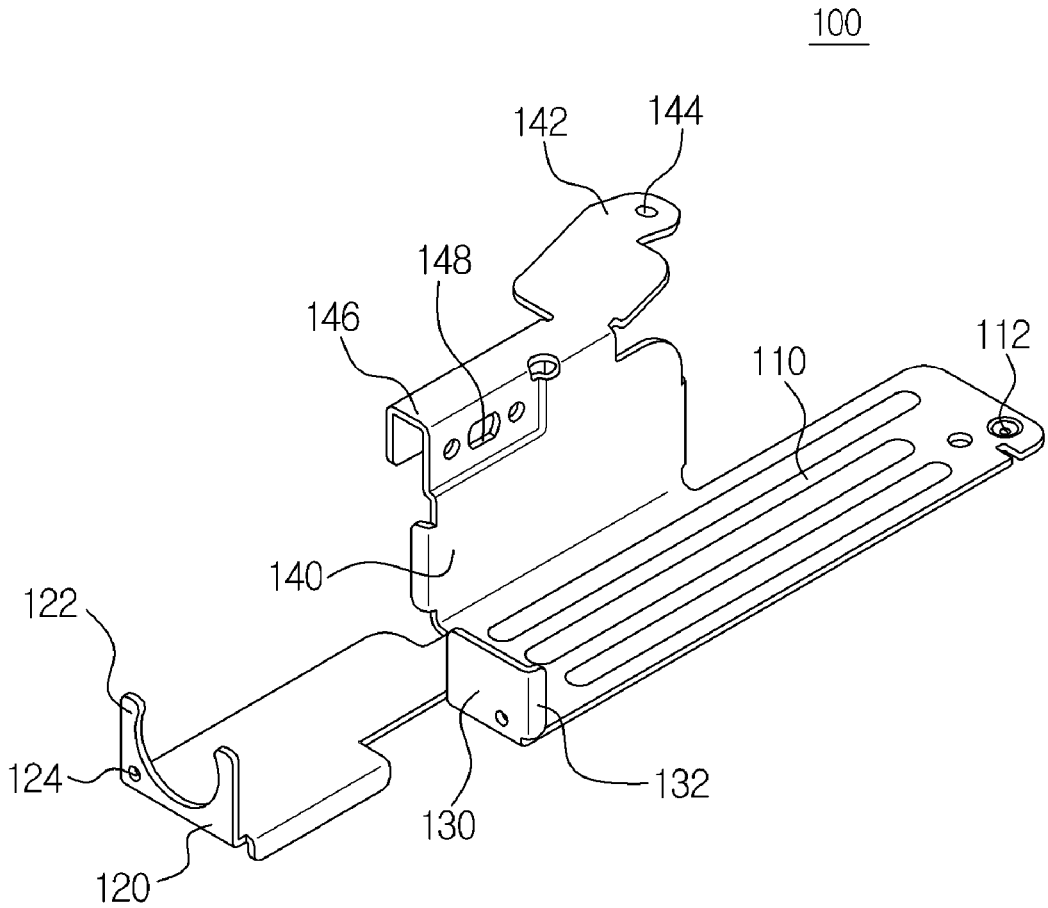
FIG. 6 is a perspective view of a support bracket.

FIG. 5 is an enlarged view of the portion 'A' of FIG. 4, and FIG. 6 is a perspective view of the support bracket.

As shown in FIGS. 5 and 6, the support bracket 100 includes a body 110, a support holder 120 bent from one side of the body 110 to accommodate and support the water supply hose 52 or the electric wire 58, a guide 130 to guide the water supply hose 52 and/or the electric wire 58 to the support holder 120, and a fixing part 140 to fix the support bracket 100 to the upper cover 80.

The body 110 connects the support holder 120, the guide 130 and the fixing part 140 to each other, and is provided with a first fixing hole 112 to fix the support bracket 100 to the bottom surface of the upper cover 80 together with the fixing part 140.

The support holder 120 includes an accommodation part 122 to accommodate the water supply hose 52 and/or the electric wire 58, and a connection hole 124 provided around the accommodation part 122.

One side of the accommodation part 122 is opened so as to accommodate the water supply hose 52 or the electric wire 58. The water supply hose 52 and/or the electric wire 58 accommodated in the accommodation part 122 is located between the accommodation part 122 and the bottom surface of the upper cover 80 under the condition that the support bracket 100 is fixed to the bottom surface of the upper cover 80.

A fixing wire 150 to fix the water supply hose 52 or the electric wire 58 to the support bracket 100 to prevent movement of the water supply hose 52 or the electric wire 58 accommodated in the accommodation part 122 during washing, is connected to the connection hole 124.

The connection hole 124 may be formed at various positions of the body 110 of the support bracket 100 other than the support holder 120.

Since the water supply hose 52 and/or the electric wire 58 is fixed to the support bracket 100 by the fixing wire 150 under the condition that water supply hose 52 or the electric wire 58 is stably accommodated in and supported by the accommodation part 122 of the support holder 120, interference of the water supply hose 52 or the electric wire 58 with the frames 11, 12 and 13 or the tub 20 due to sagging of the water supply hose 52 or the electric wire 58 is prevented, and the water supply hose 52 or the electric wire 58 does not move due to vibration generated during operation of the washing machine 1.

The guide 130 include a first contact part 132 contacting the water supply hose 52 or the electric wire 58 during a process of guiding the water supply hose 52 or the electric wire 58 to enable the water supply hose 52 or the electric wire 58 to be accommodated in the accommodation part 122 of the support holder 120. The first contact part 132 is formed in a bending or rounded structure so as to prevent the water supply hose 52 or the electric wire 58 from being damaged.

The fixing part 140 is bent from one side of the body 110 toward the upper cover 80 so as to fix the support bracket 100 to the upper cover 80. The fixing part 140 includes a second contact part 142 contacting the upper cover 80 when the support bracket 100 is fixed to the upper cover 80, and the second contact part 142 is provided with a second fixing hole 144 to connect the second contact part 142 to the upper cover 80 under the condition that the second contact part 142 contacts the bottom surface of the upper cover 80.

The fixing part 140 further includes a door connection part 146 provided in an approximately 'C' shape. The door connection part 146 is provided with a shaft connection hole 148 passing through the door connection part 146, and a hinge device 160 provided on the door 16 is rotatably connected to the shaft connection hole 148.

A method of fixing the water supply hose 52 and the electric wire 58 to the bottom surface of the upper cover 80 will be described, as follows.

First, the water supply hose 52 connected to the water supply valve 53 and the electric wire 58 connected to the control device 90 are drawn out via the through hole 89 provided on the diaphragm 88. Thereafter, the drawn water supply hose 52 and electric wire 58 are seated on the support holder 120 of the support bracket 100 and are then fixed to the support bracket 100 using the fixing wire 150. During the fixing process of the water supply hose 52 and the electric wire 58 to the support bracket 100 using the fixing wire 150, the above-described connection hole 124 provided on the support holder 120 is used. Finally, the support bracket 100 is fixed to the bottom surface of the upper cover 80 using the first fixing hole 112 and the second fixing hole 144 under the condition that the water supply hose 52 and the electric wire 58 are accommodated in and fixed to the support bracket 100.

As is apparent from the above description, a washing machine in accordance with an embodiment prevents water leakage generated by damage to a hose due to interference of the hose with other devices in the washing machine.

Further, the washing machine in accordance with an embodiment prevents electrical short or opening of the hose due to interference of the hose with other devices in the washing machine.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A washing machine comprising:

a main body;

a spin basket disposed within the main body;

an upper cover connected to an upper portion of the main body;

a door to open and close the upper cover;

a detergent box connected to a bottom surface of the upper cover to supply detergent to an inside of the spin basket;

a water supply valve connected to a rear end of the upper cover;

a water supply hose to connect the water supply valve to the detergent box; and a support bracket connected to the bottom surface of the upper cover to support the water supply hose so as to prevent sagging of the water supply hose, wherein the support bracket includes a body and a door connection part provided at one side of the body to connect the upper cover to the door.

2. The washing machine according to claim 1, wherein the support bracket includes:

a support holder bent from one side of the body to support the water supply hose.

3. The washing machine according to claim 2, wherein the support holder includes:

an accommodation part to accommodate the water supply hose; and a connection hole to which a fixing wire to fix the water supply hose accommodated in the accommodation part to the support bracket is connected.

4. The washing machine according to claim 3, wherein one side of the accommodation part is opened to accommodate the water supply hose in the accommodation part.

5. The washing machine according to claim 4, wherein the water supply hose is accommodated in the accommodation part and is located between the accommodation part and the bottom surface of the upper cover.

6. The washing machine according to claim 3, wherein the support bracket further includes a guide to guide the water supply hose to the accommodation part.

7. The washing machine according to claim 6, wherein:

the guide includes a contact part to contact the water supply hose; and the contact part is formed in a bending structure to prevent damage to the water supply hose.

8. The washing machine according to claim 2, wherein:

the support bracket includes a fixing part to fix the support bracket to the upper cover; and the fixing part is bent from one side of the support bracket.

9. The washing machine according to claim 4, wherein:

the door is connected to the upper portion of the upper cover; and the upper cover includes:

an opening opened and closed by the door;

a detergent injection hole provided at a position corresponding to the detergent box to inject the detergent into the detergent box; and a control device accommodation part at which a control device to control operation of the washing machine is located.

10. The washing machine according to claim 9, wherein the accommodation part accommodates and supports an electric wire connected to the control device together with the water supply hose.

11. The washing machine according to claim 10, wherein:

a door lock device to prevent the door from being opened during operation of the washing machine is connected to the bottom surface of the upper cover;

the door lock device is connected to the control device through the electric wire; and the electric wire is accommodated in and supported by the accommodation part together with the water supply hose.

12. A washing machine comprising:

frames forming an external appearance of the washing machine;

a spin basket disposed within the frames;

an upper cover connected to an upper portion of the frames and provided with an opening through which laundry is put into the spin basket;

a door to open and close the opening; and a support bracket fixed to a bottom surface of the upper cover to support a hose and/or an electric wire located at an inside of the upper cover, wherein the support bracket includes a body and a door connection part provided at one side of the body to connect the upper cover to the door.

13. The washing machine according to claim 12, wherein:

a hinge device is provided at both ends of the door; and the door connection part includes a shaft connection hole connected to the hinge device.

14. The washing machine according to claim 12, wherein the support bracket further includes a support holder bent from one side of the body to support the hose or the electric wire.

15. The washing machine according to claim 14, wherein the support holder includes:

an accommodation part, one side of which is opened to accommodate the hose and/or the electric wire; and a connection hole to which a fixing wire to fix the hose and/or the electric wire accommodated in the accommodation part to the support bracket is connected.

16. The washing machine according to claim 15, wherein the support holder further includes a guide to guide the hose and/or the electric wire to the accommodation part.

17. The washing machine according to claim 12, further comprising a detergent box connected to the bottom surface of the upper cover to supply detergent to the inside of the tub, wherein the upper cover includes:

a detergent injection hole provided at a position corresponding to the detergent box to inject the detergent into the detergent box; and a control device accommodation part at which a control device to control operation of the washing machine is located.

18. The washing machine according to claim 17, wherein the hose is a water supply hose to connect the detergent box to an external water supply hose to supply water to the detergent box.

19. The washing machine according to claim 17, wherein:

a door lock device to prevent the door from being opened during operation of the washing machine is connected to the bottom surface of the upper cover; and the door lock device is connected to the control device through the electric wire.

20. The washing machine according to claim 19, wherein:

the control device accommodation part is divided from an inner space, formed by the frames, by a diaphragm provided on the upper cover; and the diaphragm is provided with a through hole to pass the electric wire connecting the door lock device to the control device.

* * * * *